US011796290B2

(12) United States Patent
Ozanne

(10) Patent No.: US 11,796,290 B2
(45) Date of Patent: Oct. 24, 2023

(54) ARCHERY PROJECTILE

(71) Applicant: MCP IP, LLC, Sparta, WI (US)

(72) Inventor: Jeffrey A. Ozanne, La Crosse, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 17/463,255

(22) Filed: Aug. 31, 2021

(65) Prior Publication Data

US 2021/0396503 A1 Dec. 23, 2021

Related U.S. Application Data

(63) Continuation of application No. 16/559,355, filed on Sep. 3, 2019, now Pat. No. 11,105,593.

(60) Provisional application No. 62/726,056, filed on Aug. 31, 2018.

(51) Int. Cl.

| | |
|---|---|
| ***F42B 6/04*** | (2006.01) |
| ***F42B 6/08*** | (2006.01) |
| ***F42B 6/06*** | (2006.01) |

(52) U.S. Cl.

CPC ..... *F42B 6/08* (2013.01); *F42B 6/04* (2013.01); *F42B 6/06* (2013.01)

(58) Field of Classification Search

CPC ..... F42B 6/04; F42B 6/06; F42B 6/08

See application file for complete search history.

(56) References Cited

U.S. PATENT DOCUMENTS

| | | | |
|---|---|---|---|
| 1,424,672 | A | 8/1922 | Ogrissek |
| 3,746,334 | A | 7/1973 | Stubblefield |
| 3,815,916 | A | 6/1974 | Meszaros |
| 3,903,639 | A | 9/1975 | Howell |
| 3,946,519 | A | 3/1976 | Vadik et al. |
| 3,993,311 | A | 11/1976 | Johnson |
| 4,182,513 | A | 1/1980 | Henderson |
| 4,204,307 | A | 5/1980 | Pfetzing |
| 4,589,778 | A | 5/1986 | Mitchell |
| 4,615,529 | A | 10/1986 | Vocal |
| 4,795,165 | A | 1/1989 | Tehan |
| 4,836,557 | A | 6/1989 | Polando |
| 4,905,397 | A | 3/1990 | Juelg, Jr. |
| 5,234,220 | A | 8/1993 | Schellhammer et al. |
| 5,311,855 | A | 5/1994 | Basik |
| 5,439,231 | A | 8/1995 | Roberts et al. |
| 5,496,041 | A | 3/1996 | Broussard |
| 5,846,147 | A | 12/1998 | Basik |
| 5,863,250 | A | 1/1999 | Harris |
| 5,951,419 | A | 9/1999 | Cameneti |
| 6,179,736 | B1 | 1/2001 | Thurber |
| 6,454,623 | B1 | 9/2002 | Flatau |
| 6,695,727 | B1 | 2/2004 | Kuhn |
| 7,331,886 | B2 | 2/2008 | Morris et al. |

(Continued)

*Primary Examiner* — John A Ricci

(74) *Attorney, Agent, or Firm* — Laabs Intellectual Property

(57) ABSTRACT

In some embodiments, projectile comprises a first body portion comprising a tip, a second body portion comprising a nock and a tether attached to the first body portion and attached to the second body portion. In some embodiments, the projectile comprises a first configuration where the first body portion contacts the second body portion. In some embodiments, the projectile comprises a second configuration where the first body portion is spaced apart from the second body portion.

20 Claims, 6 Drawing Sheets

(56) References Cited

U.S. PATENT DOCUMENTS

| | | | | |
|---|---|---|---|---|
| 7,686,714 | B2 * | 3/2010 | Smith | F42B 6/04 473/578 |
| 7,909,714 | B2 | 3/2011 | Cyr et al. | |
| 8,157,679 | B2 | 4/2012 | Cyr et al. | |
| 8,465,384 | B2 | 6/2013 | Blosser et al. | |
| 8,696,498 | B1 | 4/2014 | Andrus | |
| 9,863,743 | B2 * | 1/2018 | Gall | F42B 6/06 |
| 11,105,593 | B2 * | 8/2021 | Ozanne | F42B 6/06 |

* cited by examiner

ARCHERY PROJECTILE

CROSS-REFERENCE TO RELATED APPLICATIONS

This application claims the benefit of U.S. patent application Ser. No. 16/559,355, filed Sep. 2, 2019, which claims the benefit of U.S. Patent Application No. 62/726,056, filed Aug. 31, 2018, the entire contents of which are hereby incorporated herein by reference.

BACKGROUND OF THE INVENTION

This invention relates generally to projectiles and more specifically to archery projectiles such as arrows and bolts.

Arrows are known in the art and generally include a rigid shaft and fletching. The fletching often extends helically and causes the shaft to rotate, thereby spin-stabilizing the arrow during flight. In addition to spin-stabilization, arrows can be drag-stabilized. The "static margin" is a point to point distance between the center of gravity of the arrow and center of pressure of the arrow. Typically, a larger positive static margin provides for greater arrow stability in flight.

Certain drawbacks are associated with traditional arrows. The fletching often provides a large area on the arrow that is susceptible to crosswinds. The fletching also makes the arrows bulky and more difficult to carry. The arrow shaft is susceptible to flexing and oscillations that can impact arrow flight. The specific deflection and oscillation characteristics of a given arrow shaft are difficult to predict. Inconsistency in the underlying materials and even manufacturing tolerances can cause two arrow shafts produced under the same conditions to behave differently under load. Deflections and oscillations in an arrow shaft begin at launch when a force is applied at the nock at the arrow shaft experiences a column loading scenario. The specific deflection characteristics of an arrow shaft at launch, such as direction of buckling (e.g. radial vector) and magnitude of deflection, tends to vary from arrow to arrow.

There remains a need for novel archery projectiles that maintain accuracy but reduce drawbacks associated with traditional arrows.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, projectile comprises a first body portion comprising a tip, a second body portion comprising a nock and a tether attached to the first body portion and attached to the second body portion.

In some embodiments, the projectile comprises a first configuration where the first body portion contacts the second body portion. In some embodiments, the projectile comprises a second configuration where the first body portion is spaced apart from the second body portion.

In some embodiments, the projectile comprises an internal cavity and the tether is contained in the cavity.

In some embodiments, a length of the projectile in the second configuration is greater than a length of the projectile in the first configuration. In some embodiments, the length of the projectile in the second configuration is at least 1.5 times the length of the projectile in the first configuration.

In some embodiments, the projectile excludes fletching.

In some embodiments, a projectile comprises a first body portion comprising a tip, a second body portion comprising a nock and a tether. The projectile comprises a first configuration and a second configuration. A distance between the first body portion and the second body portion is greater in the second configuration.

In some embodiments, a projectile comprises a first body portion comprising a tip and a second body portion comprising a nock. The second body portion is moveable with respect to the first body portion between a first configuration and a second configuration. A distance between the first body portion and the second body portion is greater in the second configuration.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
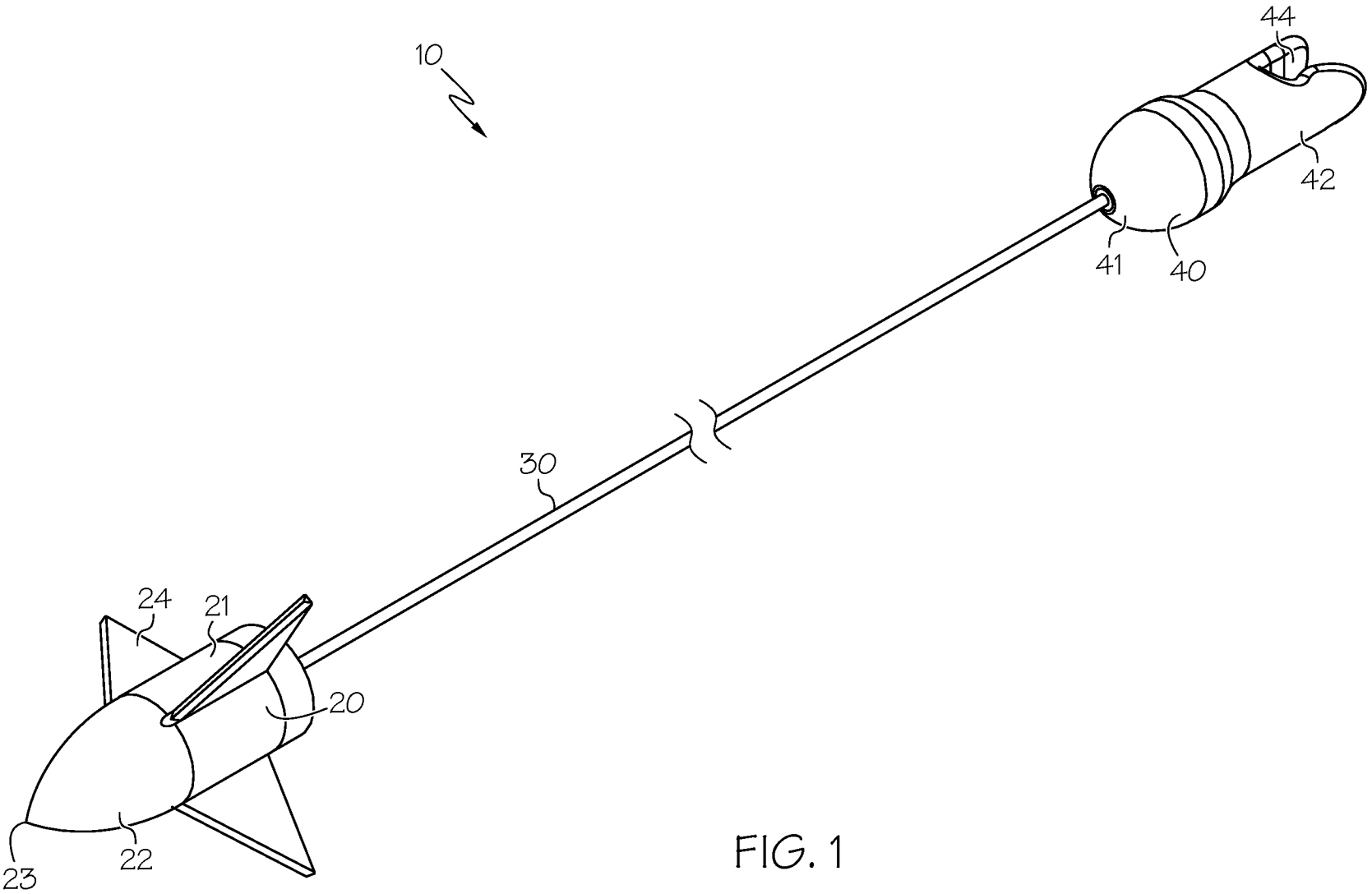
FIG. 1 shows an embodiment of a projectile.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a projectile 10 configured to be launched from an archery bow, crossbow or the like. In some embodiments, the projectile 10 comprises a first body portion 20, a tether 30 and a second body portion 40. In some embodiments, the tether 30 is attached at one end to the first body portion 20 and is attached at the other end to the second body portion 40. In some embodiments, the first body portion 20 comprises a shaft portion 21 and a tip 22. In some embodiments, the tip 22 comprises a sharp edge or point 23. In some embodiments, the tip 22 comprises a standard arrowhead field point, for example comprising helical fastening threads received by the shaft portion 21. In some embodiments, the first body portion 20 comprises a broadhead, or comprises one or more blades 24. In some embodiments, blades 24 extend outwardly above the shaft portion 21, for example in a radial direction. In some embodiments, the second body portion 40 comprises a nock 42. In some embodiments, the nock 42 comprises a notch 44 arranged to contact a bowstring.

In some embodiments, the tether 30 comprises a tension member. In some embodiments, the tether 30 is arranged to transmit tensile forces between the first and second body portions 20, 40, but the tether 30 will not transmit compressive forces between the first and second body portions 20, 40. In some embodiments, the tether 30 comprises a monofilament line, a multi-filament line, a cable, a string or any other suitable type of tension line. In some embodiments, the tether 30 comprises a metal such as aluminum or other suitable metals. In some embodiments, the tether 30 comprises a polymer or polymeric compound(s) such as polyethylene, for example the various polymers known for use in archery strings, fishing lines, etc. In some embodiments, the tether 30 is non-elastomeric. In some embodiments, the tether 30 comprises an elastomeric or rubber material. In some embodiments, the tether 30 comprises a circular cross-sectional shape. In some embodiments, the tether 30 comprises a rectangular cross-sectional shape. In some embodiments, the tether 30 comprises a strap, for example having a width dimension that exceeds a height dimension.

In some embodiments, the projectile 10 has a first configuration and a second configuration. FIG. 1 shows an embodiment of a second configuration, wherein the first body portion 20 is spaced apart from the second body portion 40. In some embodiments, the tether 30 is in tension when the projectile 10 is in the second configuration. In some embodiments, the tensile force in the second configuration stems from air drag. In some embodiments, the second configuration represents a deployed or expanded configuration. In some embodiments, the projectile 10 will assume the second configuration during and/or after the initial launch of the projectile 10. In some embodiments, the second configuration represents an in-flight configuration of the projectile 10 as it travels toward a target.

In some embodiments, the projectile 10 provides certain benefits of a traditional archery arrow while reducing potential drawbacks associated with traditional arrows. In some embodiments, the projectile 10 excludes fletching. In some embodiments, the projectile 10 excludes any radial and/or helically oriented stabilizing vanes. This can reduce accuracy errors caused by crosswinds. In some embodiments, the projectile 10 excludes a traditional arrow shaft, and thus eliminates certain issues such as shaft flexing/buckling at launch.

Figure 2:
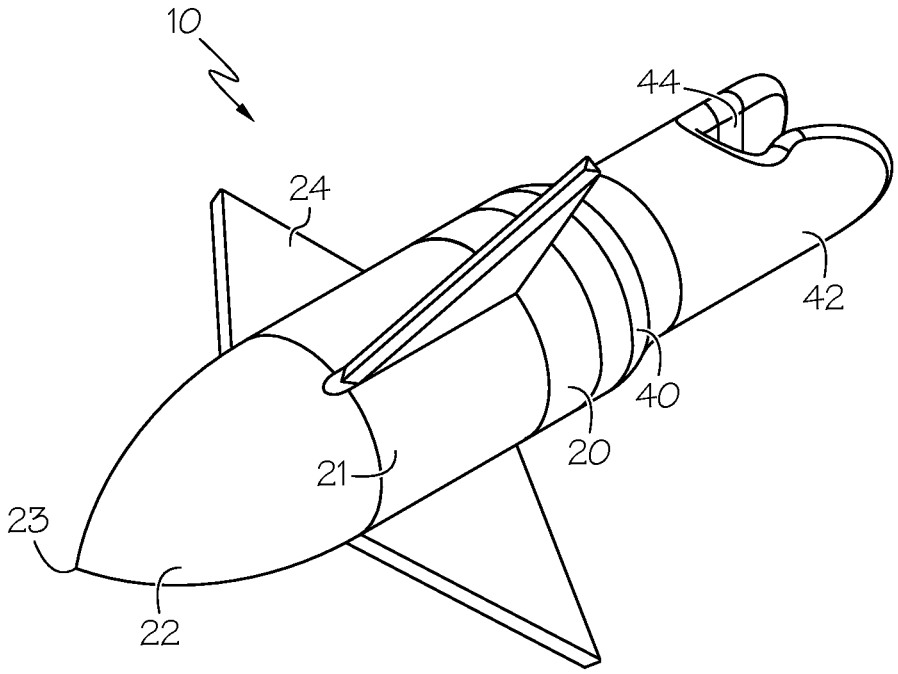
FIGS. 2 and 3 show an embodiment of a projectile in a first configuration.
Figure 3:
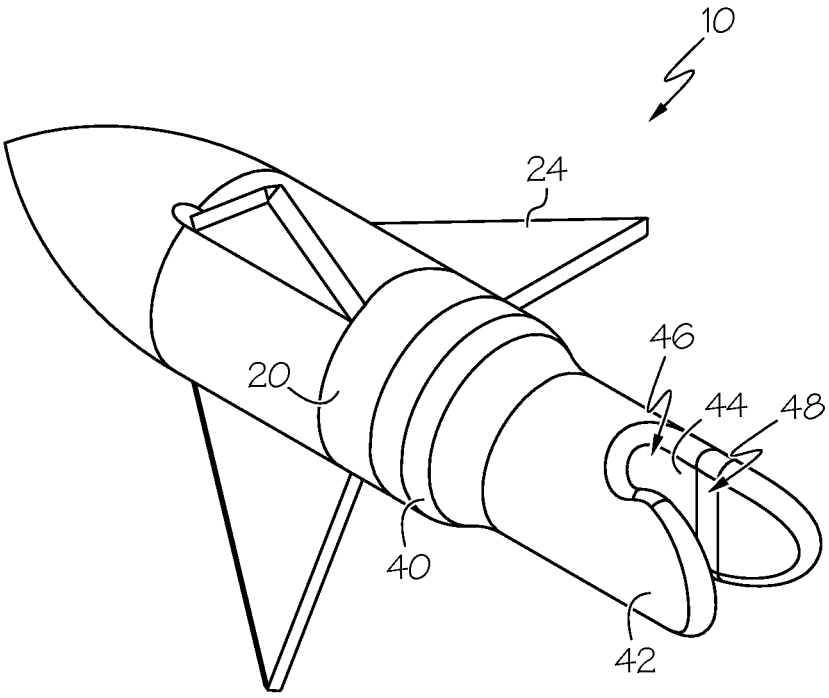

FIGS. 2 and 3 show an embodiment of a projectile 10 in the first configuration. The first body portion 20 and second body portion 40 are close to one another. As shown in FIGS. 2 and 3, the first body portion 20 contacts the second body portion 40. The tether 30 is contained within the projectile 10 and not visible in FIG. 2 or 3.

In some embodiments, in the first configuration, the projectile 10 is very compact and easily stored when compared to a traditional arrow. In some embodiments, a length of the projectile 10 in the first configuration is less than 6 inches. In some embodiments, a length of the projectile 10 in the first configuration is less than 4 inches. In some embodiments, a length of the projectile 10 in the first configuration is less than 3 inches.

In some embodiments, the projectile 10 comprises a length-to-width ratio, for example being calculated as a length of the projectile divided by a width. In some embodiments, a length-to-width ratio considers a width of the shaft portion 21. In some embodiments, blades 24 such as broadhead blades are ignored when calculating a length-to-width ratio. In some embodiments, the projectile 10 comprises a length-to-width ratio of 30 or less in the first configuration. In some embodiments, the projectile 10 comprises a length-to-width ratio of 20 or less in the first configuration. In some embodiments, the projectile 10 comprises a length-to-width ratio of 16 or less in the first configuration. In some embodiments, the projectile 10 comprises a length-to-width ratio of 10 or less in the first configuration. In some embodiments, the projectile 10 comprises a length-to-width ratio of 8 or less in the first configuration. In some embodiments, the projectile 10 comprises a length-to-width ratio of 4 or less in the first configuration. In some embodiments, the projectile 10 comprises a length-to-width ratio of 2 or less in the first configuration. For example, FIG. 2 shows an embodiment of a projectile 10 comprising a shaft portion 21 having a diameter of approximately 0.344" and a total length in the first configuration of approximately 2", and having a length-to-width ratio of approximately 5.8 (L/W=2"/0.344"=~5.8).

The nock 42 can comprise any suitable nock arrangement. In some embodiments, the nock 42 comprises a "moon nock" shape comprising an arcuate surface that is arranged to contact but not engage/retain a bowstring. In some embodiments, a nock 42 comprises an enlarged cavity 46 having a narrowed entrance 48, which is designed to engage a properly sized bowstring. In some embodiments, a distance across the narrowed entrance 48 is less than a nominal diameter of a bowstring. In some embodiments, when the nock 42 is configured to engage a bowstring, during launch of the projectile 10, the first body portion 20 and second body portion 40 can begin moving away from one another before the nock 42 becomes fully disengaged from the bowstring.

In some embodiments, the first body portion 20 and the second body portion 40 are configured relative to one another to encourage the first body portion 20 to separate from the second body portion 40 during flight.

In some embodiments, the second body portion 40 produces a greater amount of drag than the first body portion 20. In some embodiments, a total amount of drag attributable to the second body portion 40 exceeds a total amount of drag attributable to the first body portion 20. In some embodiments, in the first configuration, the second body portion 40 produces a greater amount of drag than the first body portion 20.

In some embodiments, the first body portion 20 comprises a mass that is greater than a mass of the second body portion 40. In some embodiments, the first body portion 20 comprises a greater mass than the second body portion 40 and produces a lesser amount of drag than the second body portion 40. In some embodiments, the first body portion 20 is configured to carry more momentum than the second body portion 40.

In some embodiments, the second body portion 40 is larger in size (e.g. diameter) than the first body portion 20, or comprises portions that extend radially outwardly above the surface of the first body portion 20. Thus, in some embodiments, the second body portion 40 comprises one or more drag surfaces that extend outward above the first body portion 20 when the projectile is in the first (e.g. undeployed) configuration. The drag surface(s) will encourage the body portions 20, 40 to separate during flight.

In some embodiments, the second body portion 40 comprises a maximum radial dimension that is equal to or less than the first body portion 20.

Figure 4:
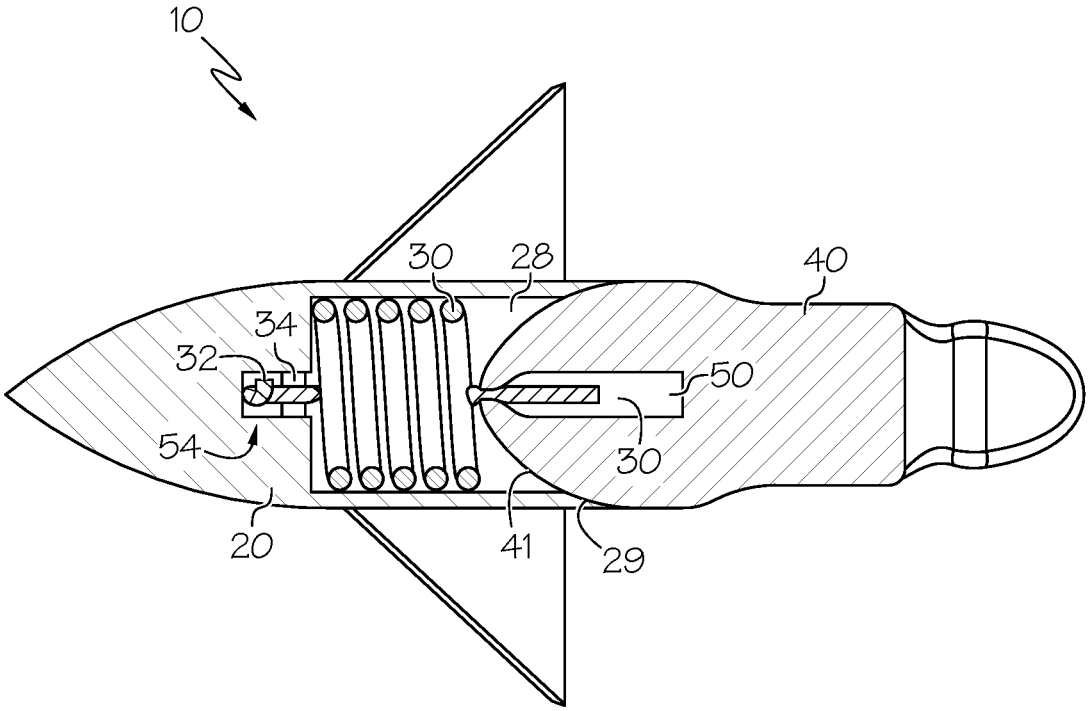
FIG. 4 shows a cross-sectional view of an embodiment of a projectile.

FIG. 4 shows a cross-sectional view of an embodiment of a projectile 10 in the first configuration.

In some embodiments, the projectile 10 in the first configuration comprises a cavity 28. In some embodiments, the tether 30 is contained in the cavity 28 when the projectile 10 is in the first configuration. In some embodiments, the tether 30 comprises a midportion that is oriented in the cavity 28 in the first configuration and is oriented outside of the cavity 28 in the second configuration.

In some embodiments, the first body portion 20 comprises the cavity 28. In some embodiments, the tether 30 is coiled within the cavity 28.

In some embodiments, the tether 30 comprises an elastic material. In some embodiments, the tether 30 is arranged to elastically deform as the first body portion 20 moves away from the second body portion 40. In some embodiments, the tether 30 stretches and elongates as the projectile 10 transitions from the first configuration to the second configuration. In some embodiments, a stress level experienced by the tether 30 is higher in the second configuration than in the first configuration. In some embodiments, the stress level experienced by the tether 30 is less than the yield stress of the tether 30. In some embodiments, the tether 30 is stretched in the second configuration. In some embodiments, the tether 30 is collapsed in the cavity 28 in the first configuration.

In some embodiments, the second body portion 30 comprises a nose cone 41 or other suitable aerodynamically shaped surface. In some embodiments, the nose cone 41 can comprise various shapes including conic, arcuate, elliptical, parabolic, bi-conic, spherically blunted shapes, any suitable ogive shape, any suitable solid of revolution shape, etc.

In some embodiments, the tether 30 extends through a tip of the nose cone 41 of the second body portion 30.

In some embodiments, the first body portion 20 comprises a contacting surface 29 arranged to contact the second body portion 40. In some embodiments, the contacting surface 29 contacts a portion of the nose cone 41. In some embodiments, the contacting surface 29 is shaped to mate with and/or properly abut with the nose cone 41.

The tether 30 can be attached to the body portions 20, 40 in any suitable way. In some embodiments, a fastener such as a screw fastener engages the tether 30 and a body portion 20, 40. In some embodiments, the body portion 20, 40 is crimped or swaged to the tether 30. In some embodiments, an adhesive is used. In some embodiments, a knot 32 can be tied in one or both ends of the tether 30 to increase engagement. In some embodiments, a crimp ring 34 is used. In some embodiments, a crimp ring 34 can comprise a tapered shape, and the size of a central aperture of the crimp ring 34 is reduced in size as the crimp ring 34 is installed. For example, in some embodiments, the cavity 28 comprises a portion 54 for retaining the tether 30, and a crimp ring 34 is arranged to reduce the size of a central aperture as the crimp ring 34 is pressed into the cavity portion 54. In some embodiments, the tether 30 has varying diameters allowing for axial interference attachment methods with first body portion 20. In some embodiments, the tether 30 has varying heights and/or widths allowing for axial interference attachment methods with first body portion 20.

In some embodiments, the second body portion 40 comprises a cavity 50, and a portion of the tether 30 is oriented in the cavity 50. In some embodiments, the cavity 50 is centered upon a central axis of the second body portion 40.

Figure 5:
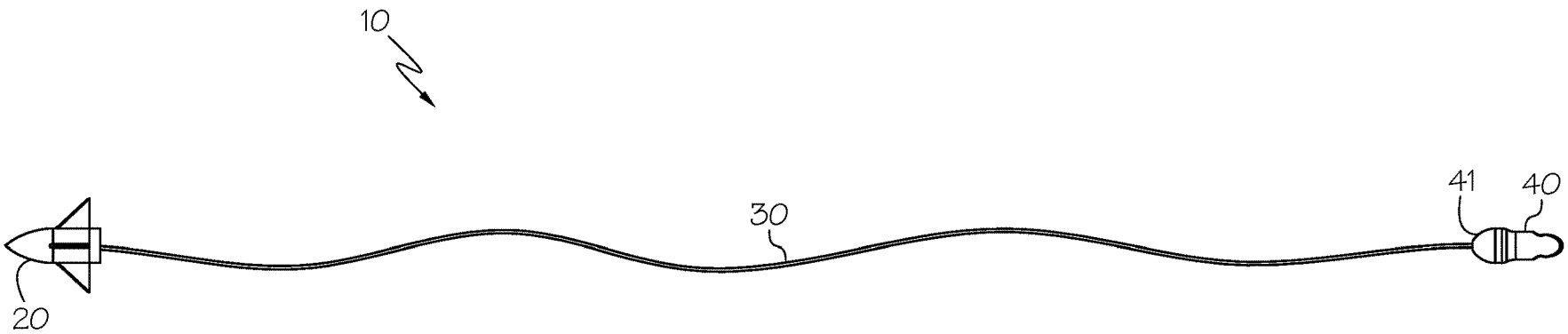
FIGS. 5 and 6 show an embodiment of a projectile during deployment.
Figure 6:
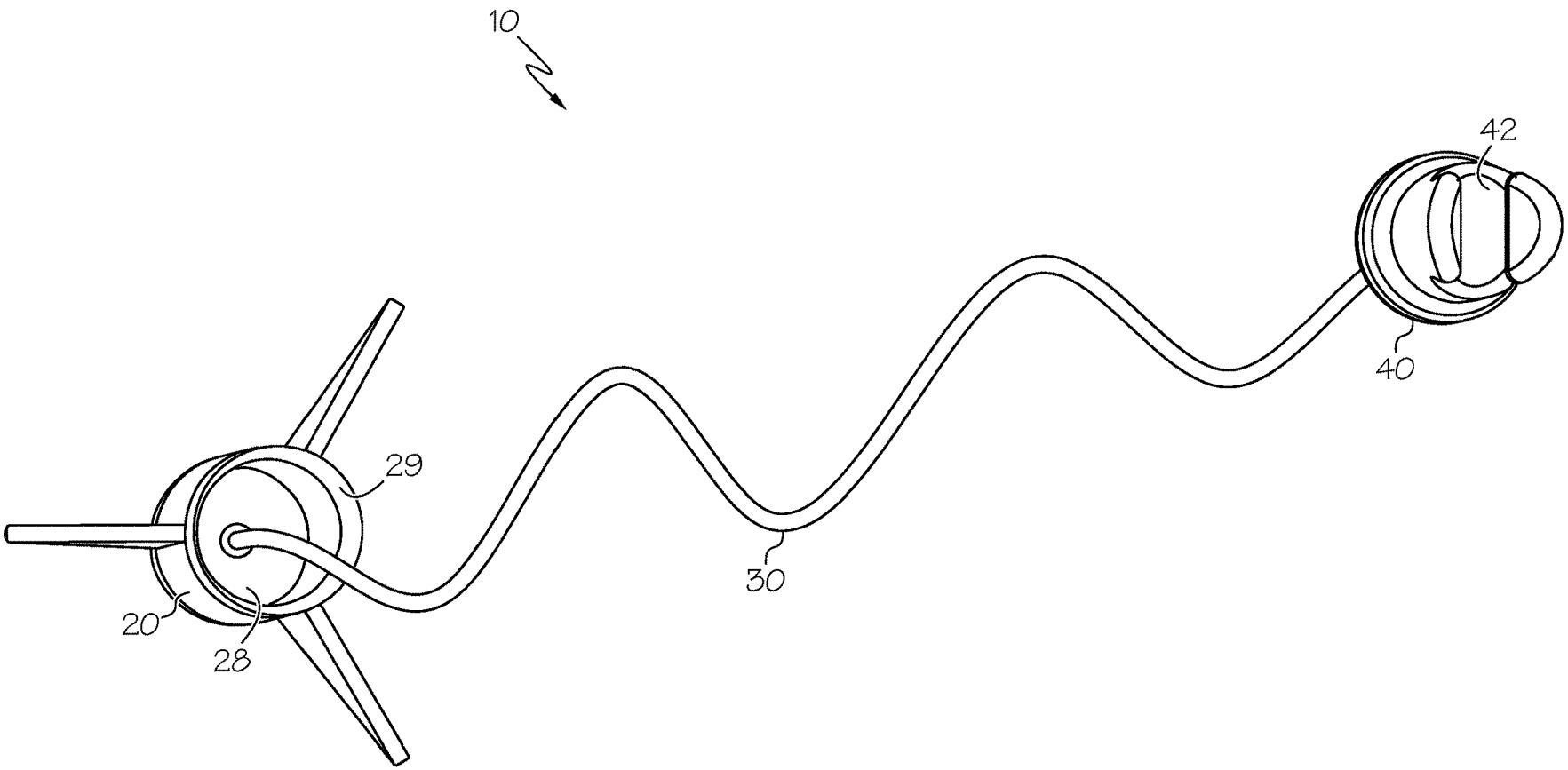

FIGS. 5 and 6 show an embodiment of a projectile 10 as it is deploying and transitioning from the first configuration to the second configuration.

Desirably, the projectile 10 will reach the fully deployed configuration as shown in FIG. 1.

In some embodiments, the tether 30 can have any suitable length. In the second configuration, the first body portion 20 can be separated from the second body portion 40 by any suitable distance.

In some embodiments, the projectile 10 will increase in length as the projectile transitions from the first configuration to the second configuration. In some embodiments, the length of the projectile 10 in the second configuration is at least 1.1 times the length of the projectile 10 in the first configuration. In some embodiments, the length of the projectile 10 in the second configuration is at least 1.5 times the length of the projectile 10 in the first configuration. In some embodiments, the length of the projectile 10 in the second configuration is at least 2 times the length of the projectile 10 in the first configuration. In some embodiments, the length of the projectile 10 in the second configuration is at least 5 times the length of the projectile 10 in the first configuration. In some embodiments, the length of the projectile 10 in the second configuration is at least 8 times the length of the projectile 10 in the first configuration.

In various embodiments, the projectile 10 can increase in length any suitable amount between the first configuration and the second configuration. In various embodiments, the length of the projectile 10 in the second configuration can range from 1 to 10+ times the length of the projectile 10 in the first configuration.

In some embodiments, a length of the tether 30 portion extending between the first portion 20 and second portion 40 is greater than a length of the projectile 10 in the first configuration.

In some embodiments, the projectile 10 defines a static margin. In some embodiments, the static margin is a linear distance between the center of gravity of the projectile 10 and the aerodynamic center of pressure of the projectile 10. The stability of the projectile 10 in flight tends to increase as the static margin increases.

In some embodiments, a projectile 10 defines a static margin in the first configuration in the range of −1 inch to 2 inches. In some embodiments, a projectile 10 defines a static margin in the second configuration in the range of 1 inch to 25 inches In some embodiments, as the distance between the first body portion 20 and the second body portion 40 increases, the static margin will also increase. In some embodiments, a center of gravity of the projectile 10 is located forward of a center of drag of the projectile 10 when the projectile 10 is in the second configuration. In some embodiments, a static margin of the projectile 10 is positive when the projectile 10 is in the second configuration.

In some embodiments, the static margin can be increased by increasing an amount of drag associated with the second body portion 40, for example by increasing the size and/or shape dimensions of the second body portion 40. In some embodiments, the static margin can be increased by increasing an amount of mass associated with the first body portion 20, for example by increasing tip weight. In some embodiments, the static margin can be increased by a combination of these methods.

Figure 7:
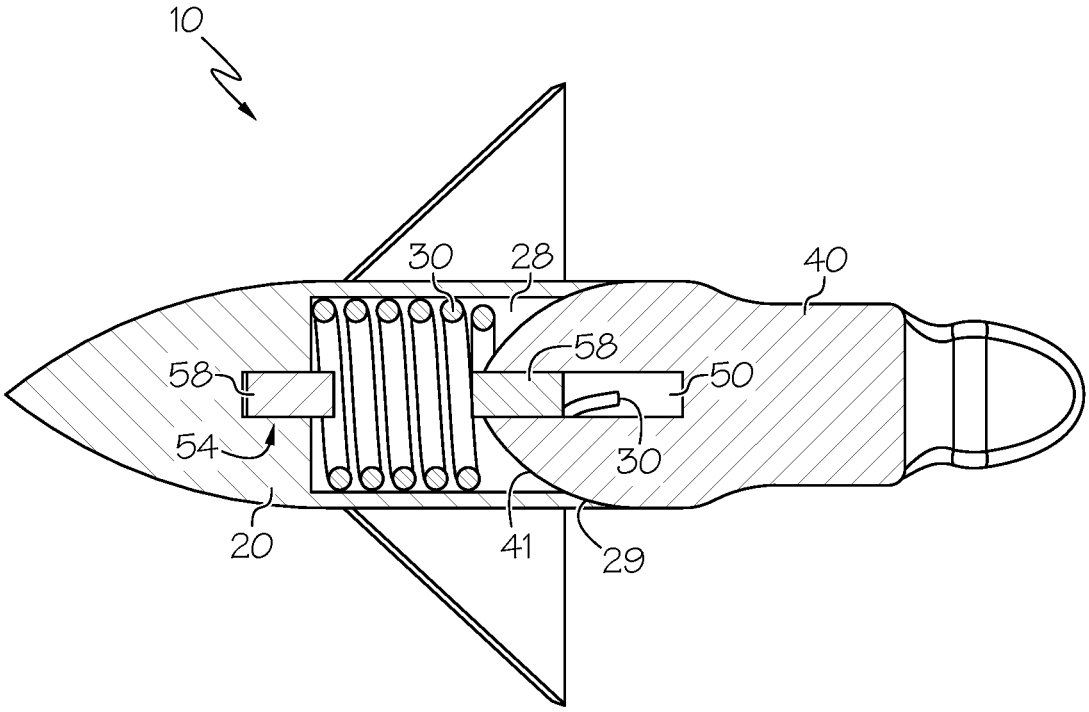
FIG. 7 shows a cross-sectional view of another embodiment of a projectile.

FIG. 7 shows a cross-sectional view of another embodiment of a projectile 10. In some embodiments, a plug 58 is used to engage the tether 30 to a cavity portion 50, 54.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A projectile comprising:

a first body portion comprising a tip;

a second body portion comprising a nock; and a tether attached to the first body portion and attached to the second body portion;

the projectile having a first configuration and a second configuration, a distance between the first body portion and the second body portion being greater in the second configuration, the second configuration comprising an in-flight configuration of the projectile.

2. The projectile of claim 1, wherein the first body portion contacts the second body portion in the first configuration.

3. The projectile of claim 2, the projectile comprising an internal cavity, the tether contained in the cavity.

4. The projectile of claim 3, wherein a portion of the second body portion extends into the internal cavity.

5. The projectile of claim 2, wherein the first body portion is spaced apart from the second body portion in the second configuration.

6. The projectile of claim 5, wherein a length of the projectile in the second configuration is at least 1.1 times a length of the projectile in the first configuration.

7. The projectile of claim 6, wherein the length of the projectile in the second configuration is at least 3 times the length of the projectile in the first configuration.

8. The projectile of claim 1, comprising a length-to-width ratio of 30 or less.

9. The projectile of claim 1, comprising a length-to-width ratio of 10 or less.

10. The projectile of claim 1, the tether comprising an inelastic material.

11. The projectile of claim 1, the tether comprising an elastomeric material.

12. The projectile of claim 1, the second body portion comprising a nose cone.

13. The projectile of claim 12, the tether extending from a tip of the nose cone.

14. The projectile of claim 1, the projectile excluding fletching.

15. The projectile of claim 1, the first body portion comprising a cavity, the tether comprising a midportion oriented in the cavity in the first configuration.

16. The projectile of claim 15, the midportion oriented outside of the cavity in the second configuration.

17. The projectile of claim 1, wherein the length of the projectile in the second configuration is at least 1.5 times the length of the projectile in the first configuration.

18. A projectile comprising:

a first body portion comprising a tip;

a second body portion comprising a nock;

the second body portion moveable with respect to the first body portion between a first configuration and a second configuration, a distance between the first body portion and the second body portion being greater in the second configuration, the second configuration comprising an in-flight configuration of the projectile.

19. The projectile of claim 18, the second body portion excluding fletching.

20. The projectile of claim 18, wherein the length of the projectile in the second configuration is at least 1.5 times the length of the projectile in the first configuration.

* * * * *